US011541266B2

(12) United States Patent
Schwartz

(10) Patent No.: US 11,541,266 B2
(45) Date of Patent: Jan. 3, 2023

(54) EXERCISE DEVICE

(71) Applicant: EXERSPIDER LLC, Toledo, OH (US)

(72) Inventor: Gregg A. Schwartz, Toledo, OH (US)

(73) Assignee: EXERSPIDER LLC, Toledo, OH (US)

( * ) Notice: Subject to any disclaimer, the term of this patent is extended or adjusted under 35 U.S.C. 154(b) by 56 days.

(21) Appl. No.: 17/125,242

(22) Filed: Dec. 17, 2020

(65) Prior Publication Data

US 2021/0178210 A1 Jun. 17, 2021

Related U.S. Application Data

(60) Provisional application No. 62/948,874, filed on Dec. 17, 2019.

(51) Int. Cl.

| | |
|---|---|
| ***A63B 21/04*** | (2006.01) |
| ***A63B 21/00*** | (2006.01) |
| ***A63B 23/035*** | (2006.01) |
| ***A63B 21/055*** | (2006.01) |

(52) U.S. Cl.

CPC ..... *A63B 21/0442* (2013.01); *A63B 21/0557* (2013.01); *A63B 21/4047* (2015.10); *A63B 23/03583* (2013.01)

(58) Field of Classification Search

CPC ..... A63B 21/02; A63B 21/04; A63B 21/0552; A63B 21/159; A63B 21/0442; A63B 21/0557; A63B 21/4047; A63B 21/1609; A63B 21/1672; A63B 21/4007; A63B 21/00043; A63B 21/4025; A63B 23/03583; A63B 23/03541; A63B 23/03575; A63B 2071/063; A63B 2225/20; A63B 2225/50

See application file for complete search history.

(56) References Cited

U.S. PATENT DOCUMENTS

| | | | | |
|---|---|---|---|---|
| 5,569,138 | A * | 10/1996 | Wang | A63B 23/03533 482/130 |
| 5,743,838 | A * | 4/1998 | Willis | A63B 21/1609 482/125 |
| 7,226,402 | B1 * | 6/2007 | Joya | A63B 23/12 482/121 |
| 8,162,809 | B1 | 4/2012 | Eastwood | |
| 2005/0159276 | A1 * | 7/2005 | Falcone | A63B 21/0552 482/129 |
| 2008/0051256 | A1 * | 2/2008 | Ashby | A63B 71/0622 482/1 |

(Continued)

*Primary Examiner* — Erin Deery
*Assistant Examiner* — Peter H Forstner
(74) *Attorney, Agent, or Firm* — Shumaker, Loop & Kendrick, LLP; James D. Miller

(57) ABSTRACT

An exercise device includes a base member configured for engaging a surface of a mounting structure, a coupling system for coupling the base member to the structure, and at least one resistance member coupled to the base member. Each of the at least one resistance members includes a control member configured to be manipulated by a portion of a user. The mounting structure includes a first surface and an oppositely arranged second surface with the first surface facing towards the user and the second surface configured to engage the base member. The configuration of the base member relative to the mounting structure allows for at least a portion of a force applied to one of the resistance members to be transferred to the mounting structure.

16 Claims, 8 Drawing Sheets

(56) References Cited

U.S. PATENT DOCUMENTS

| | | | | |
|---|---|---|---|---|
| 2013/0203567 | A1* | 8/2013 | Thomas | A63B 21/4025<br>482/124 |
| 2016/0263420 | A1* | 9/2016 | DuMee | A63B 21/4043 |
| 2018/0290002 | A1* | 10/2018 | Colangelo | A63B 21/00043 |

* cited by examiner

EXERCISE DEVICE

CROSS-REFERENCE TO RELATED APPLICATION

This patent application claims priority to U.S. Provisional Patent Application Ser. No. 62/948,874, filed on Dec. 17, 2020, the entire disclosure of which is hereby incorporated herein by reference.

FIELD OF THE INVENTION

The invention relates to a portable exercise device for performing various conditioning, strengthening, stretching, and rehabilitation exercises. The portable exercise device is also configured for removable coupling to a variety of different mounting structures such as chairs, beds, wheelchairs, and the like.

BACKGROUND OF THE INVENTION

Many exercise devices for use by the average consumer utilize resistive forces to work muscle. In particular, many exercise devices incorporate the use of resistance members such as elastic ropes or bands for application of these resistive forces. The resistance member may include one end securely coupled to a stationary structure and another end having a grip, handle, loop, or the like for a hand or foot of the user to engage. The user then moves the hand or foot to extend the resistance member against the resistive forces thereof. The resistance member may alternatively include a handle or grip at each end thereof wherein the user stretches the resistance member against the resistive forces thereof while the user grasps each of the opposing ends of the resistance member.

There are several drawbacks to the use of resistance members that are anchored at one end to a stationary structure. The position and orientation of the stationary structure may render it difficult for certain individuals to access such exercise devices. For example, a person restricted to a wheelchair or a hospital bed may be incapable of accessing such an exercise device.

In U.S. Pat. No. 8,162,809, a portable exercise device is disclosed that requires a user of the exercise device to sit on the exercise device in a manner wherein a weight of the user opposes the resistive forces of an extendable resistance member. However, such an exercise device disadvantageously requires a portion of the body of the user to apply a force to the exercise device during use thereof. Such an exercise device may not be suitable for use with a user having an injury or disability in a manner wherein the application of the opposing force is uncomfortable or likely to cause additional harm to the portion of the body of the user. Additionally, the requirement that the user sits on the exercise device greatly limits the possible applications for the exercise device.

Therefore, a need exists for an exercise device that allows a user to comfortably and conveniently perform one or more conditioning, strengthening, stretching, or rehabilitation exercises while overcoming the limitations of the prior art.

SUMMARY OF THE INVENTION

Compatible and attuned with the present invention, an exercise device configured for coupling to a variety of different structures having different configurations has surprisingly been discovered.

In one embodiment of the invention, an exercise device includes a base member configured for engaging a surface of a mounting structure, a coupling system for coupling the base member to the structure, and at least one resistance member coupled to the base member. Each of the at least one resistance members includes a control member configured to be manipulated by a portion of a user. The mounting structure includes a first surface and an oppositely arranged second surface with the first surface facing towards the user and the second surface configured to engage the base member. The configuration of the base member relative to the mounting structure allows for at least a portion of a force applied to one of the resistance members to be transferred to the mounting structure.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings.

DETAILED DESCRIPTION OF THE INVENTION

Figure 1:
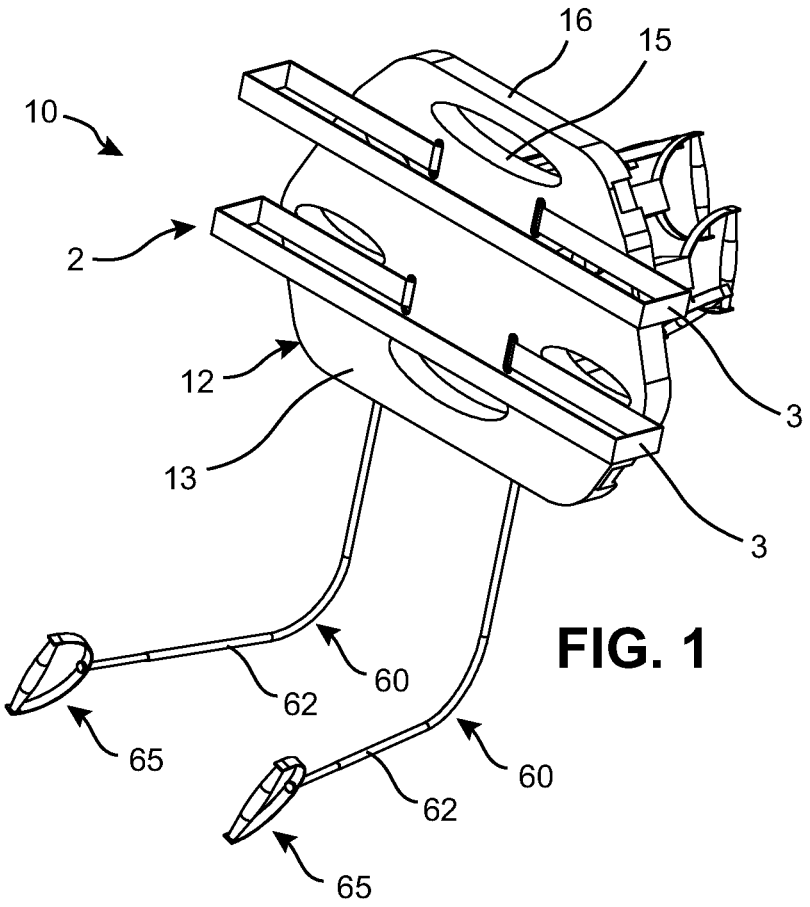
FIG. 1 is a front perspective view of an exercise device according to an embodiment of the invention wherein the exercise device is in a retracted configuration.
Figure 2:
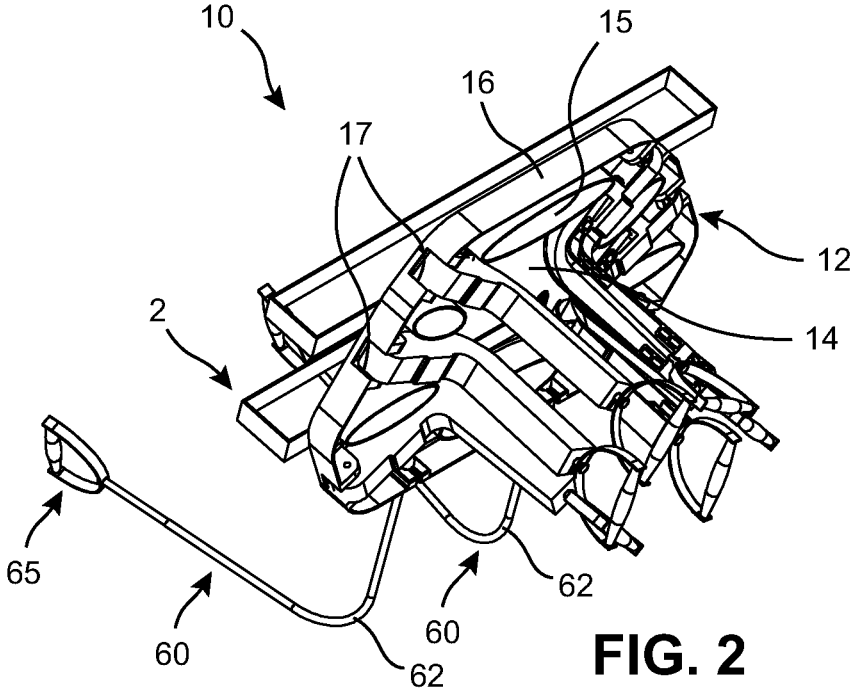
FIG. 2 is a rear perspective view of the exercise device when in the retracted configuration.

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

FIGS. 1-10 illustrate an exercise device 10 according to an embodiment of the present invention. The exercise device 10 is portable and configured for use with a variety of different structures such as chairs, sofas, beds, benches, wheelchairs, and the like, as explained hereinafter. The exercise device 10 shown in FIGS. 1-10 comprises a base member 12, an array of arms 30, and a plurality of resistance members 60.

The exercise device 10 is shown in FIGS. 7-10 as being coupled to a chair 1000 as one non-limiting example of a structure suitable for use with the exercise device 10. The chair 1000 is shown as having a seat 1001, a pair of legs 1002 depending downwardly from the seat 1001, and a backrest 1003 extending upwardly from the seat 1001. An opening 1004 is formed between the pair of the legs 1002 at a position below the seat 1001. The backrest 1003 includes a front surface 1005 configured to engage the back of a user sitting in the chair 1000 and a rear surface 1006 formed opposite the front surface 1005 and facing away from the user. As explained in greater detail hereinafter, the rear surface 1006 of the backrest 1003 is configured to engage the base member 12 when the exercise device 10 is placed in an operational configuration relative to the chair 1000.

One skilled in the art should appreciate that the chair 1000 as shown and described may be illustrative of any number of similar structures suitable for use with and coupling to the exercise device 10. Those structures suitable for use with and coupling to the exercise device 10 are hereinafter referred to as mounting structures. Generally, the exercise device 10 is configured for use with any mounting structure having a first (front) surface configured to face towards and/or engage a surface of a user of the exercise device 10 and a second (rear) surface formed opposite the first surface and configured to face towards and engage a surface of the base member 12. The surface of the user facing towards and potentially engaging the first surface of the mounting structure may commonly be a rearward facing (posterior) surface of the user, such as a back or buttocks of the user, although the exercise device 10 may be utilized with the other surfaces of the user facing towards and optionally engaging the exercise device 10 depending on the type of exercise being performed by the user. For example, some exercises may require a side facing surface or a front facing surface of the user to face towards and optionally engage the first surface of the mounting structure in order to prescribe the desired motions of the user during execution of the corresponding exercise.

The disclosed configuration of those mounting structures suitable for operational use with the exercise device 10 results in a portion of the mounting structure defining the first and second surfaces thereof being disposed between the user and the base member 12 when the exercise device 10 is coupled to the mounting structure. The mounting structure is also configured to allow for the arms 30 and/or the resistance members 60 to pass around or through the mounting structure from the first surface to the oppositely arranged second surface for manipulation by the user when the user is properly positioned adjacent the mounting structure. In addition to traditional sitting or sleeping structures, the exercise device 10 may be suitable for use with various posts, poles, fences, frames, benches, natural features (trees, rock formations, etc.), or the like, so long as the exercise device 10 can be positioned relative to the user in the operational configuration while securely mounted to the corresponding mounting structure. The mounting structures suitable for use with the exercise device 10 may themselves be portable and/or capable of adjustment, as desired. The mounting structures suitable for use with the exercise device 10 may alternatively be fixed in position and/or fixed in configuration, as desired.

Each of the resistance members 60 includes a flexible body 62 and a control member 65. Each of the flexible bodies 62 extends longitudinally from a first end to a second end. The first end is configured for coupling the corresponding flexible body 62 directly to the base member 12 or directly to one of the arms 30 while the second end is configured for coupling the corresponding flexible body 62 to one of the control members 65. As used herein, references to one of the resistance members 60 being coupled to the base member 12 may refer to one of the resistance members 60 being directly coupled to the base member 12 or may refer to one of the resistance members 60 being indirectly coupled to the base member 12 via an intervening structure such as one of the arms 30. In either case, a force generated during an extension of one of the resistance members 60 is able to be transferred at least partially to a point of contact present between base member 12 and the corresponding mounting structure 12.

The flexibility of each of the flexible bodies 62 allows for each of the flexible bodies 62 to curve, bend, and pivot in directions lateral to the longitudinal direction thereof when each of the flexible bodies is manipulated by a portion of the user, and especially when the user manipulates a position of the corresponding one of the control members 65. The first end and/or the second end of each of the flexible bodies 62 may each include a fitting, coupling, mating feature, or the like configured to facilitate the removable coupling of each of the ends to the previously identified components. Such fitting, couplings, or mating features may include interlocking complimentary structures, snap-fit connections, threaded connections, quick connect and disconnect swivel connections, clipping connections, locking connections, clamping connections, spring loaded connections, or the like, as is known in the art.

Each of the control members 65 may be a grip, handle, loop, or similar structure capable of being controlled by a portion of the body of the user, such as a hand or a foot of the user. Each of the control members 65 may be removably coupled to the second end of each of the flexible bodies 62 or each of the control members 65 may be formed by a configuration of the second end of each of the flexible bodies 62, such as by looping a portion of each of the flexible bodies 62 for receiving the hand or foot of the user, for example. Any combination of the previously disclosed configurations may be utilized during use of the exercise device 10 while remaining within the scope of the present invention, including any variety of control members 65 (handles, loops, grips, etc.) disposed at the second ends of any number of the flexible bodies 62.

Each of the flexible bodies 62 is formed from a flexible and elastically deformable material configured to provide a resistive force when a portion of the corresponding flexible body 62 is extended in the longitudinal direction thereof. Each of the flexible bodies 62 is configured wherein the resistive force generated within the corresponding flexible body 62 during the extension of the corresponding flexible body 62 has a known relationship relative to the distance of longitudinal extension of the corresponding flexible body 62. Each of the flexible bodies 62 may be formed from an elastically flexible polymeric material such as latex, as one non-limiting example.

Each of the flexible bodies 62 is shown as having a substantially cylindrical shape with a corresponding circular cross-section. However, other cross-sectional shapes may be utilized while remaining within the scope of the present invention, including square shapes, rectangular shapes, elliptical shapes, hexagonal shapes, and so on, so long as the flexible body 62 has the desired characteristics, such as flexibility and elasticity, for carrying out the prescribed exercise.

Although the resistance members 60 have been described in the form of elastically flexible polymeric bands, substantially any material or any structural configuration of the resistance members 60 may be utilized in conjunction with the exercise device 10 to perform an exercise while remaining within the scope of the present invention. For example, the resistance members 60 may alternatively be in the form of an elastically bendable component that is selectively bent relative to the base member 12 or one of the arms 30, such as bow-like structure having a distal end that is grasped and moved relative to a stationary base connected to the base member 12 or one of the arms 30. As another example, the resistance members 60 may be provided as spring elements configured for coupling to the base member 12 or one of the arms 30, such as a helical extension spring that is selectively extended and retracted during the associated exercises.

Substantially any structure capable of being mounted to a corresponding feature of the exercise device 10 while also providing a resistive force during a user performed exercise may be representative of one of the resistance members 60 while remaining within the scope of the present invention. Additionally, any feature or structure associated with the corresponding resistance member 60 that is capable of being grasped, guided, or otherwise controlled by the user during an exercise may be representative of one of the control members 65. In some instances, the resistance member 60 and the control member 65 may include complimentary structure for removably coupling the control member 65 to the resistance member 60. In other instances, the control member 65 may be incorporated into the structure of the resistance member 60.

The exercise device 10 may also include one or more of the resistance members 60 having different characteristics from the remainder of the resistance members 60 to better customize the training session of the user. For example, one of the resistance members 60 having a control member 65 configured for engagement with a hand of the user may have a different elasticity, a different resistive force, a different length, a different diameter, or be formed from a different material in comparison to one of the resistance members 60 configured for engagement of the foot of the user. Each of the resistance members 60 may be further configured to provide a variable resistive force based on a user selected setting. The amount of force required to perform a motion using one of the resistance members 60 may accordingly be selected to accommodate the abilities of the user. The resistive force of each of the resistance members 60 may be increased as the user continues to progress, thereby allowing the exercise device 10 to continue to provide challenging training sessions for an improving user of the exercise device 10.

The base member 12 is plate-like in structure and includes a first major surface 13 and an oppositely arranged second major surface 14. The first major surface 13 is configured to face towards and engage the second (rear) surface of the corresponding mounting structure normally facing away from the user of the exercise device 10. In the present example, the first major surface 13 is configured to face towards and engage the rear surface 1006 of the chair 1000. The first major surface 13 may alternatively be referred to as a front surface of the exercise device 10 due to the forward facing orientation of the first major surface 13. Similarly, the second major surface 14 may alternatively be referred to as a rear surface of the exercise device 10 due to the rearward facing orientation of the second major surface 14.

In the illustrated example, each of the first major surface 13 and the second major surface 14 is substantially planar with the surfaces 13, 14 arranged substantially parallel to each other. However, it should be apparent that the base member 12 may include contrary configurations suitable for engaging a specific range of mounting structures, such as the first major surface 13 having a concave shape configured to conform to a convex second (rear) surface of the corresponding mounting structure, or other complimentary configurations, as desired. Although not pictured, a pad, pillow, or other compressible and/or deformable component may be disposed on or otherwise mounted to the first major surface 13 for engaging the second surface of the mounting structure and conforming to the shape thereof in order to ensure that the first major surface 13 makes sufficient contact with the second surface of the mounting structure when the second surface has an irregular or discontinuous configuration.

The base member 12 is shown in FIGS. 1-10 as having a substantially hexagonal perimeter shape, but the base member 12 may have alternative shapes and configurations so long as the base member 12 allows the user to access the arms 30 and/or the resistance members 60 via a routing of the corresponding components around the mounting structure. The base member 12 may alternatively be rectangular, triangular, trapezoidal, octagonal, elliptical, or irregularly shaped, as non-limiting examples. The dimensions of the base member 12 may be selected to ensure that the arms 30 and/or resistance members 60 are disposed adjacent a peripheral portion of the mounting structure connecting the opposing first and second surfaces thereof.

The base member 12 also includes an array of apertures 15 formed therethrough from the first major surface 13 to the second major surface 14. Each of the apertures 15 may be provided as a portion of the exercise device 10 suitable for the user to grip and handle when manipulating the base member 12 or each of the apertures 15 may form a through opening for receiving a hook, post, or similar structure when hanging or storing the exercise device 10. The base member 12 is shown as including six of the apertures 15 arranged about a perimeter thereof with each of the apertures 15 having an elliptical shape extending longitudinally in a substantially radial direction of the base member 12. However, any number of the apertures 15 may be utilized in any configuration with the apertures 15 having any desired shape and orientation relative to the remainder of the base member 12, as desired.

The base member 12 may include any number of raised, ribbed, or flanged portions for reinforcing the otherwise plate-like configuration thereof against the stresses that may be experienced by the base member 12 during use of the exercise device 10, such as bending stresses generated within the base member 12 when specific ones of the resistance members 60 are being utilized by the user. In the illustrated embodiment, the base member 12 includes a substantially tray-like configuration with a rim 16 projecting outwardly from a perimeter of the second major surface 14 with the rim 16 projecting in a direction substantially perpendicular to the plane of the second major surface 14. A perimeter of each of the apertures 15 is also shown as having a rimmed configuration for further reinforcing the base member 12. Alternative reinforcing configurations may be utilized in forming the base member 12 while remaining within the scope of the present invention, as desired.

The base member 12 includes an array of pivoting structures 18 arranged around the perimeter of the second major surface 14. Each of the pivoting structures 18 is configured to form a pivoting connection with one of the arms 30 for pivotally adjusting each of the arms 30 between a retracted position (FIGS. 1-3, 7, and 8) and an operational position (FIGS. 4-6, 9, and 10). Each of the pivoting structures 18 is formed by a pair of tabbed projections 19 extending away from the second major surface 14 in similar fashion to the extension of the rim 16. Each pivoting structure 18 defines an axis of rotation of a corresponding one of the arms 30 with each of the axes of rotation extending between the opposing tabbed projections 19 of each of the pivoting structures 18. The tabbed projections 19 may include aligned openings configured to receive an axel or other rotary shaft about which one of the arms 30 may selectively pivot. The axel or rotary shaft may be formed by a nut and bolt combination, as one non-limiting example, wherein the bolt is received through the aligned openings formed through the tabbed projections 19 as well as a corresponding opening formed through one of the arms 30 before receiving the nut. The tabbed projections 19 may also include contrary structure for forming the axis of rotation of each of the arms 30, as desired, without departing from the scope of the present invention.

Each of the axes of rotation is arranged to be substantially parallel to an adjacent and outwardly positioned portion of the perimeter of the base member 12 as defined by the rim 16. Each of the axes of rotation is also positioned inwardly of the perimeter of the base member 12 as defined by the rim 16 to facilitate the second major surface 14 of the base member 12 forming a stopping surface for preventing over-rotation of each of the arms 30, as explained in greater detail when discussing the structure and manner of operation of the arms 30. Each of the tabbed projections 19 intersects and merges with the rim 16 about the perimeter of the base member 12 to form an opening 17 at each of the pivoting structures 18. Each of the openings 17 provides a space through which a portion of a corresponding one of the arms 30 can extend when the corresponding one of the arms 30 is adjusted to the operational position thereof.

The base member 12 is shown as further comprising a pair of anchoring structures 22 disposed at or adjacent a lowermost portion of the base member 12 (with respect to the gravity direction) when the base member 12 is installed to the corresponding mounting structure such as the chair 1000. Each of the anchoring structures 22 may be configured for removably coupling one of the resistance members 60 directly to the base member 12 in the absence of the intervening structure of one of the arms 30.

In the illustrated embodiment, each of the anchoring structures 22 is provided as a key-hole shaped opening or slot formed through a reinforced (thickened) portion of the rim 16. More specifically, the key-hole shaped opening or slot penetrates the rim 16 from an outer edge thereof in a direction towards the second major surface 14 of the base member 12. The entry portion of the keyhole shape formed at the edge of the rim 16 may be tapered such that the flexible body 62 of a corresponding one of the resistance members 60 may be pressed through the narrowest portion of the key-hole shape with the flexible body 62 compressing to pass through the narrowest portion before springing back to the cylindrical shape when reaching the distally arranged circular portion of the key-hole shape. The first end of the flexible body 62 includes an enlarged or bulbous portion (explained in greater detail when discussing FIGS. 12 and 13) having a diameter great enough to prevent passage of the enlarged portion axially through the key-hole shape. As such, the anchoring structure 22 prevents axial passage of the flexible body 62 from the key-hole shape while also restricting the flexible body 62 to be removable from the key-hole shape only by pulling the flexible body 62 laterally through the narrowest portion of the tapered key-hole shape despite the narrowest portion having a smaller diameter than the non-compressed flexible body 62.

Alternative coupling methods may be utilized for coupling one of the resistance members 60 to the base member 12 at one of the anchoring structures 22 while remaining within the scope of the present invention. For example, the anchoring structures 22 and the first ends of each of the flexible bodies 62 may include complimentary fittings, couplings, or other mating structures for removably coupling the components to each other, so long as the forces carried through the flexible bodies 62 are able to be transferred to the base member 12 in the manner described hereinafter when describing a method of use of the exercise device 10.

The base member 12 further includes a coupling system 2 for coupling the base member 12 to a mounting structure such as the chair 1000. As illustrated, the coupling system 2 includes a pair of straps 3 with each of the straps 3 fed through a respective one of two pairs of strap slots 24 formed through the base member 12. In the provided embodiment, a first portion of each of the straps 3 is fed along the second major surface 14 when extending between the paired strap slots 24 while a second portion of each of the straps 3 extends away from the base member 12 for wrapping around the mounting structure associated with the exercise device 10 such as the chair 1000 of FIGS. 7-10, wherein the first and second portions cooperate to form a closed loop around the coupling structure.

Each of the straps 3 is shown in FIGS. 7-10 as being formed from a substantially elastic material configured to expand around the backrest 1003 of the chair 1000 and then retract thereabout to secure the position of the exercise device 10 relative to the chair 1000. However, this is merely one exemplary structure suitable for use with the base member 12, as substantially any structure suitable for mounting the base member 12 relative to the corresponding mounting structure may be utilized while remaining within the scope of the present invention. For example, the straps 3 may be provided as free ended straps such as lashing straps or ratcheting straps that allow for the user to tighten a loop formed by such straps around the desired portion of the mounting structure while joining the opposing free ends of each of the straps. As another example, the straps 3 may be free ended with each of the free end portions being associated with a corresponding buckle or other releasable connection, wherein an additional tightening mechanism is utilized to control an amount of overlap between the end portions of the corresponding strap 3. As a third example, the straps 3 may be configured to be tied around or otherwise looped around a corresponding feature of the mounting structure. Alternative mounting structures and tightening mechanisms may be utilized while remaining within the scope of the present invention, so long as the exercise device 10 is able to be removably coupled to the corresponding mounting structure via the coupling system 2 in a manner preventing undesired motion of the base member 12 during use of the exercise device 10.

Each of the arms 30 extends from a first end 31 pivotally coupled to the base member 12 at one of the pivoting structures 18 to a freely disposed second end 32, which may alternatively be referred to as the distal end 32 of each of the arms 30. In the provided embodiment, each of the arms 30 has a two-legged configuration including a first leg 33 including the first end 31 and a second leg 34 including the second end 32, wherein the second leg 34 extends from a distal end of the first leg 33 spaced from the corresponding pivoting structure 18.

The first leg 33 is arranged at an angle relative to the second leg 34 of each of the arms 30. In the embodiment illustrated in FIGS. 1-10, the angle present between the first leg 33 and the second leg 34 is about 90 degrees. However, other angles may be present between the first leg 33 and the second leg 34 while remaining within the scope of the present invention, so long as the distal end 32 of the corresponding arm 30 is capable of being positioned relative to the user in a manner wherein the user may properly manipulate whatever resistance member 60 is associated with the corresponding arm 30. The angle present between the legs 33, 34 allows for each of the arms 30 to substantially wrap around the mounting structure from a position rearward of the mounting structure to a position in front of the mounting structure when the corresponding one of the arms 30 is placed in the operational position thereof. The angle present between the legs 33, 34 may be substantially any angle between 0 and 180 degrees, depending on the specific application. In some embodiments, one or more of the arms 30 may be rectilinear and devoid of the two-legged configuration, as desired. In other embodiments, the angle present between the legs 33, 34 may be between 45 degrees and 135 degrees, as desired.

As mentioned previously, each of the arms 30 is configured to pivot about the first end 31 thereof relative to the substantially stationary base member 12 following a coupling of the base member 12 to the corresponding mounting structure. The pivoting of each of the arms 30 relative to the base member 12 may be performed manually by the user between each session of use of the exercise device 10.

Each of the arms 30 may be placed in the retracted position thereof wherein the first leg 33 of the corresponding arm 30 is placed in abutment with the second major surface 14 of the base member 12 and the second leg 34 extends rearwardly away from the second major surface 14 at an angle transverse (perpendicular) to the plane of the second major surface 14. The second major surface 14 forms a stopping surface of the base member 12 for limiting the pivoting of each of the arms 30 beyond the retracted position. A first surface of the first leg 33 makes the contact with the second major surface 14 when the corresponding arm 30 is in the retracted position.

When in the retracted position, an entirety of the corresponding arm 30 may be disposed rearward of the base member 12 and the rearwardly facing second surface of the mounting structure. The manner in which each of the second legs 34 extends rearwardly at a position behind the base member 12 allows for a profile of the exercise device 10 to be reduced in the lateral direction to reduce a packaging or storage space necessary for the exercise device 10 while also preventing undesired interference of any of the arms 30 with the user when other portions of the exercise device 10 are being utilized.

Each of the arms 30 may also be placed in the operational position thereof wherein the first leg 33 of the corresponding arm 30 is placed in abutment with the second major surface 14 of the base member 12 and the second leg 34 extends forwardly beyond the base member 12 and the mounting structure in a direction towards the user. The second major surface 14 once again forms a stopping surface of the base member 12 for limiting the pivoting of each of the arms 30 beyond the operational position. A second surface of the first leg 33 makes the contact with the second major surface 14 when the corresponding arm 30 is in the operational position, wherein the second surface of the first leg 33 is arranged opposite the first surface thereof.

Each of the arms 30 may be configured such that the distal end 32 of each of the arms 30 is disposed beyond the first (front) surface of the mounting structure when in the operational position, as desired, so long as the user can access whatever resistance member 60 and/or control member 65 is associated with the corresponding arm 30. The second leg 34 of each of the arms 30 once again extends transversely (perpendicularly) relative to the plane of the second major surface 14 when in the operational position.

Figure 3:
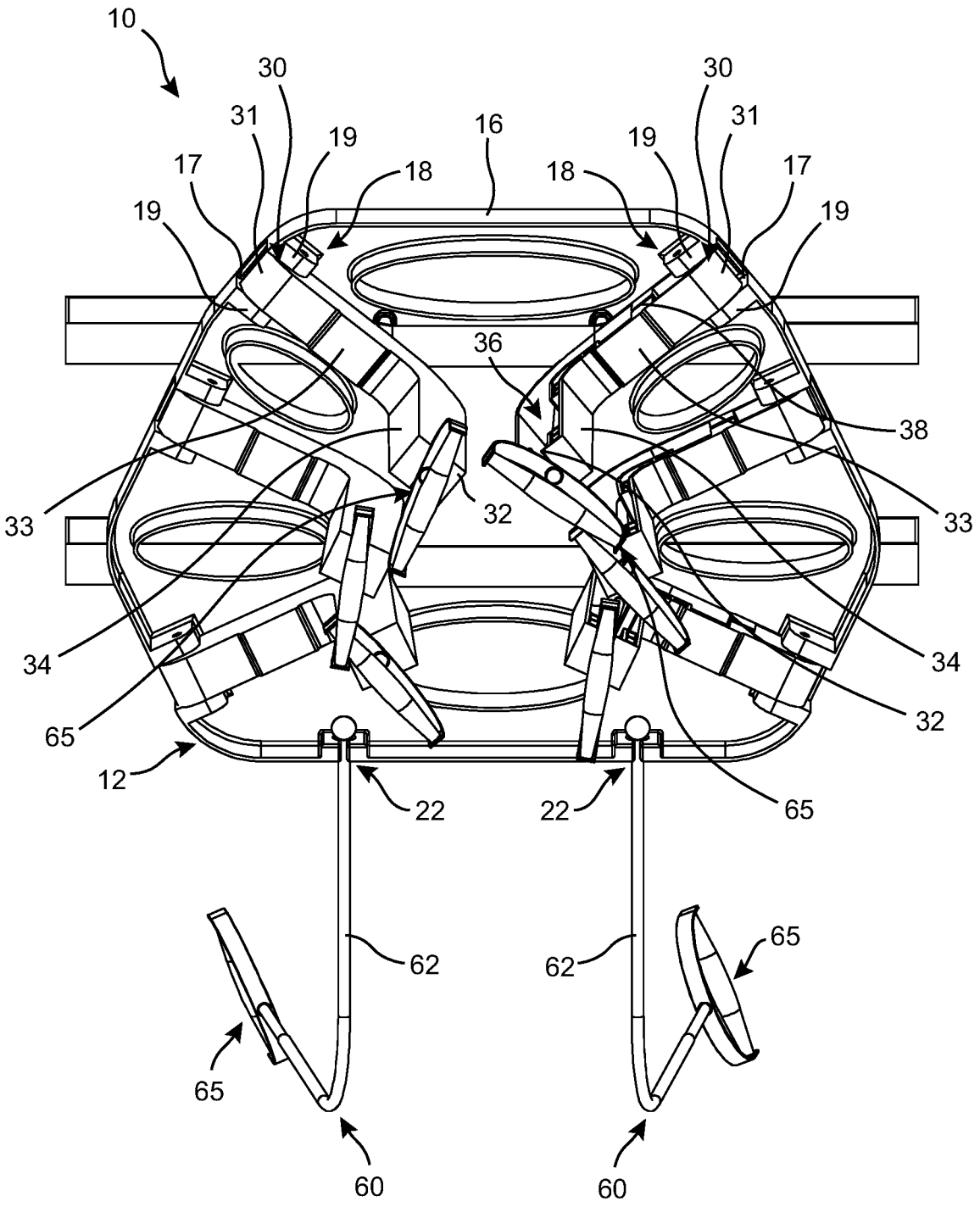
FIG. 3 is a rear elevational view of the exercise device when in the retracted configuration.
Figure 4:
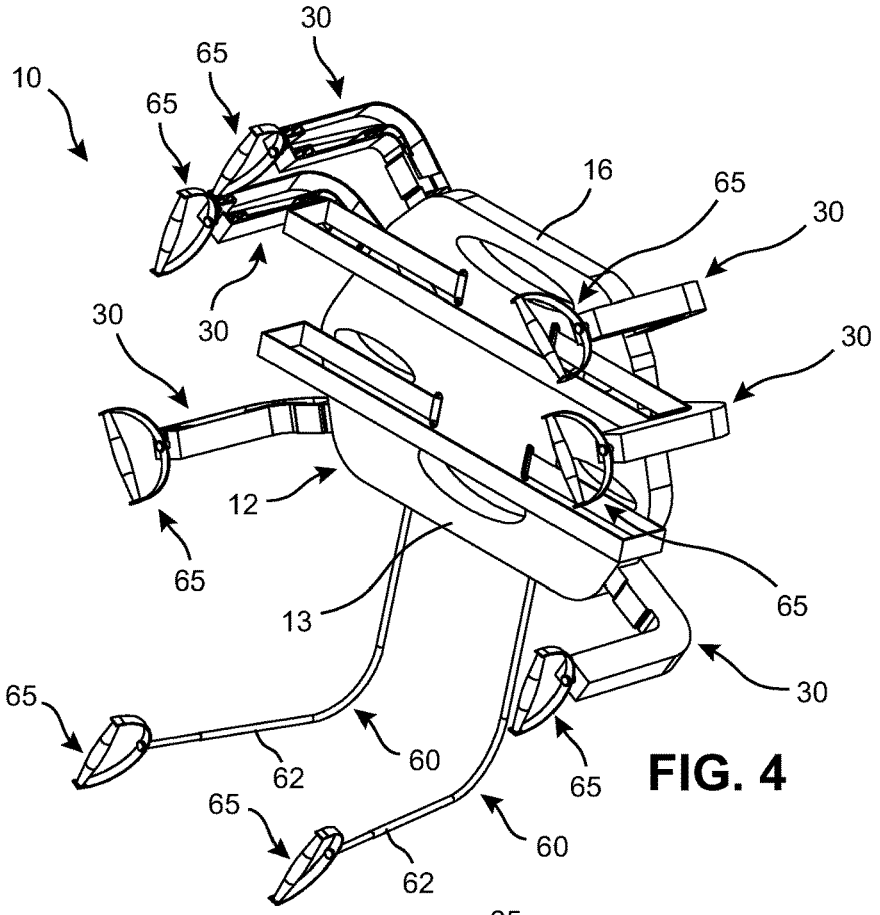
FIG. 4 is a front perspective view of the exercise device wherein the exercise device is in an operational configuration.
Figure 5:
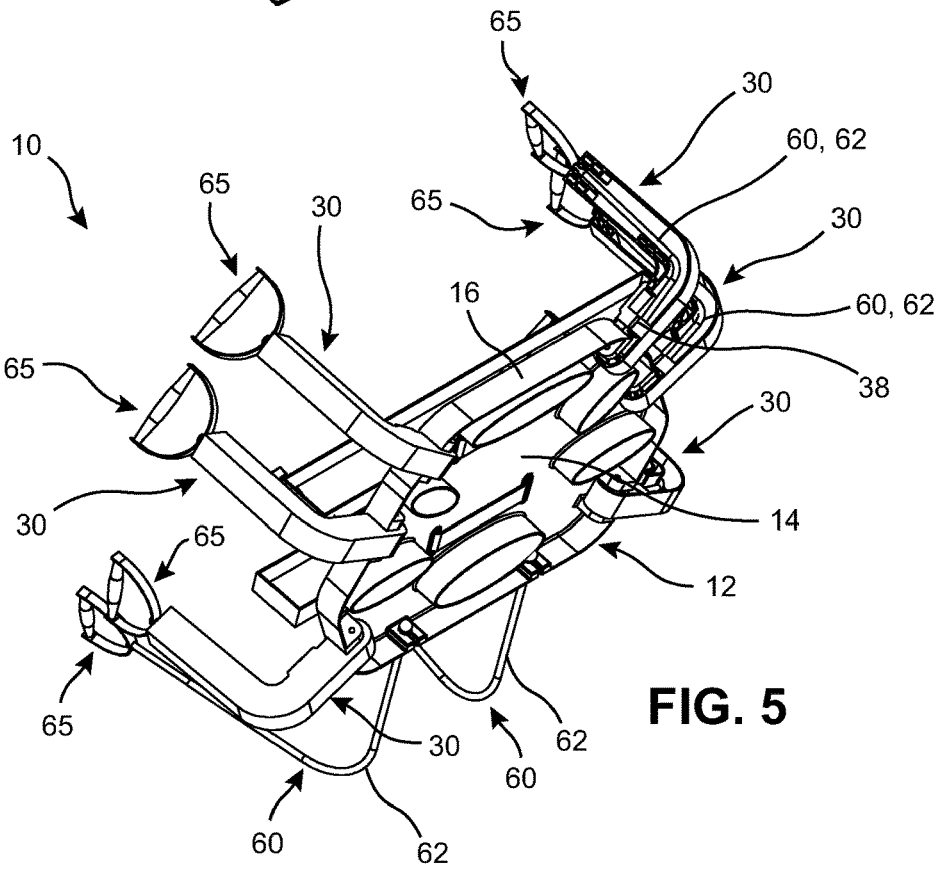
FIG. 5 is a rear perspective view of the exercise device when in the operational configuration.
Figure 6:
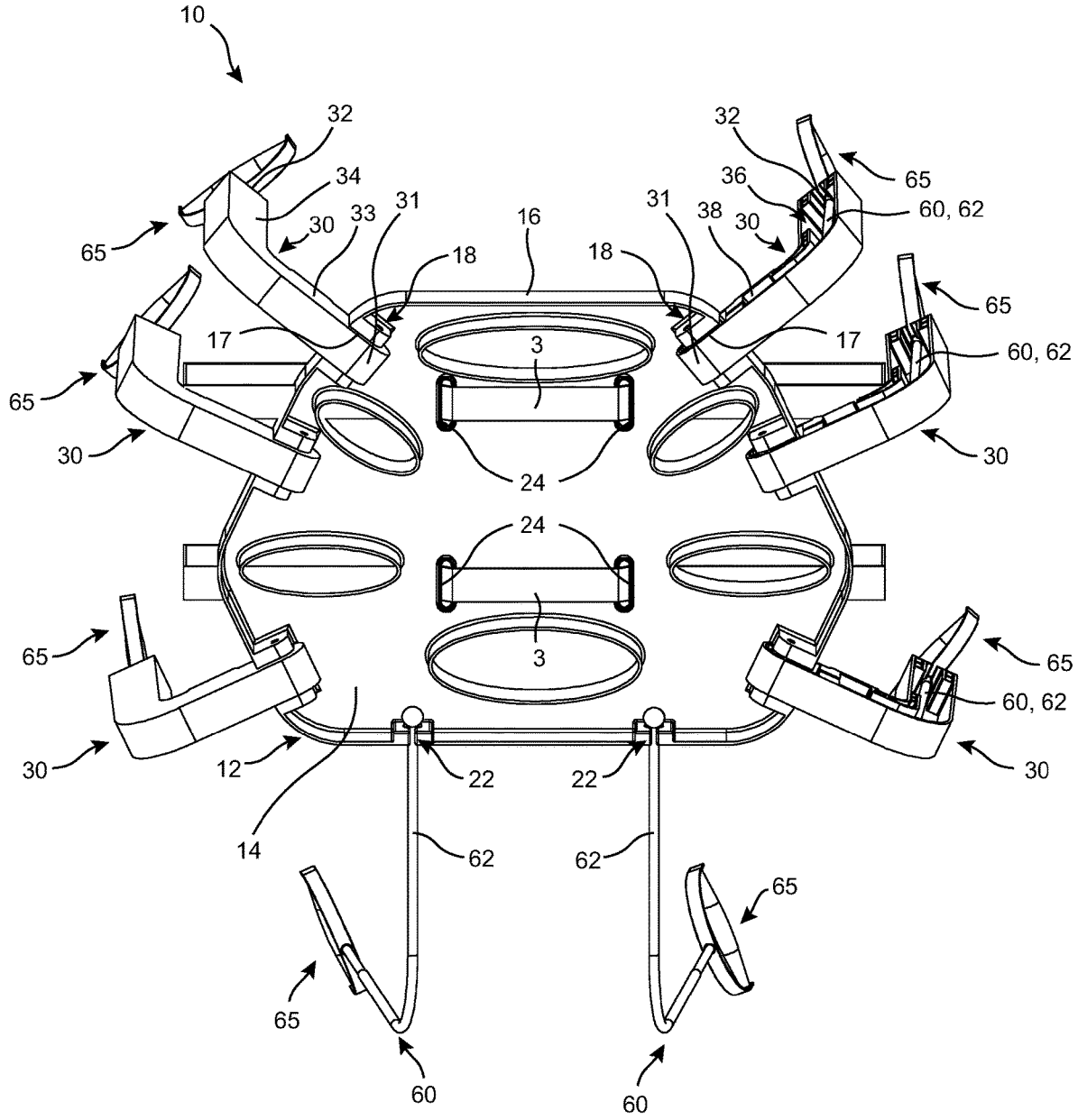
FIG. 6 is a rear elevational view of the exercise device when in the operational configuration.
Figure 8:
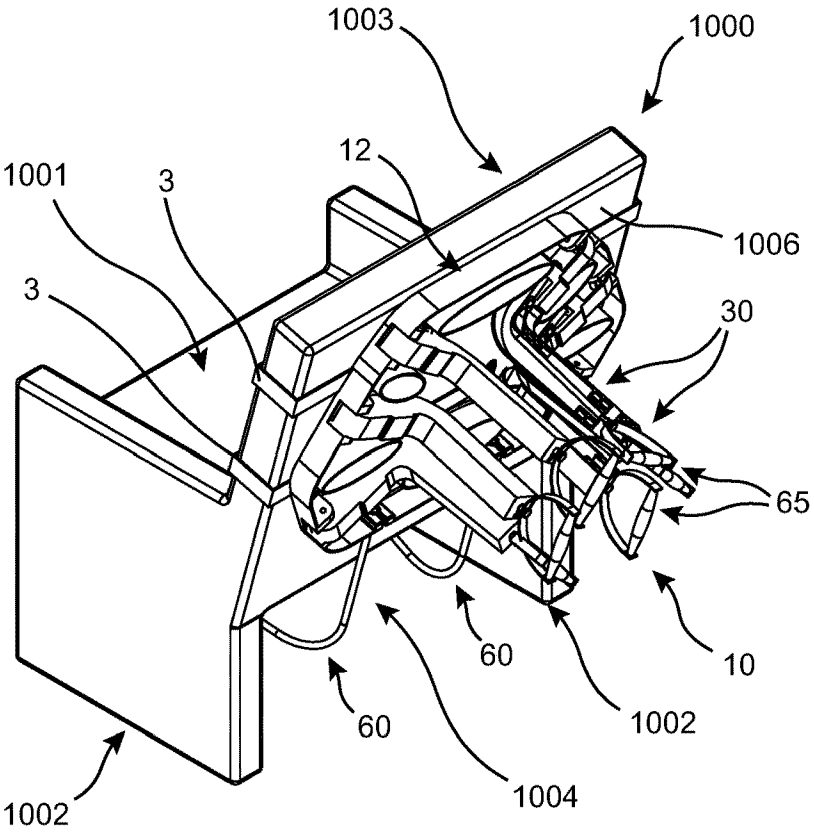
FIG. 8 is a rear perspective view of the exercise device when coupled to the mounting structure with the exercise device in the retracted configuration.
Figure 7:
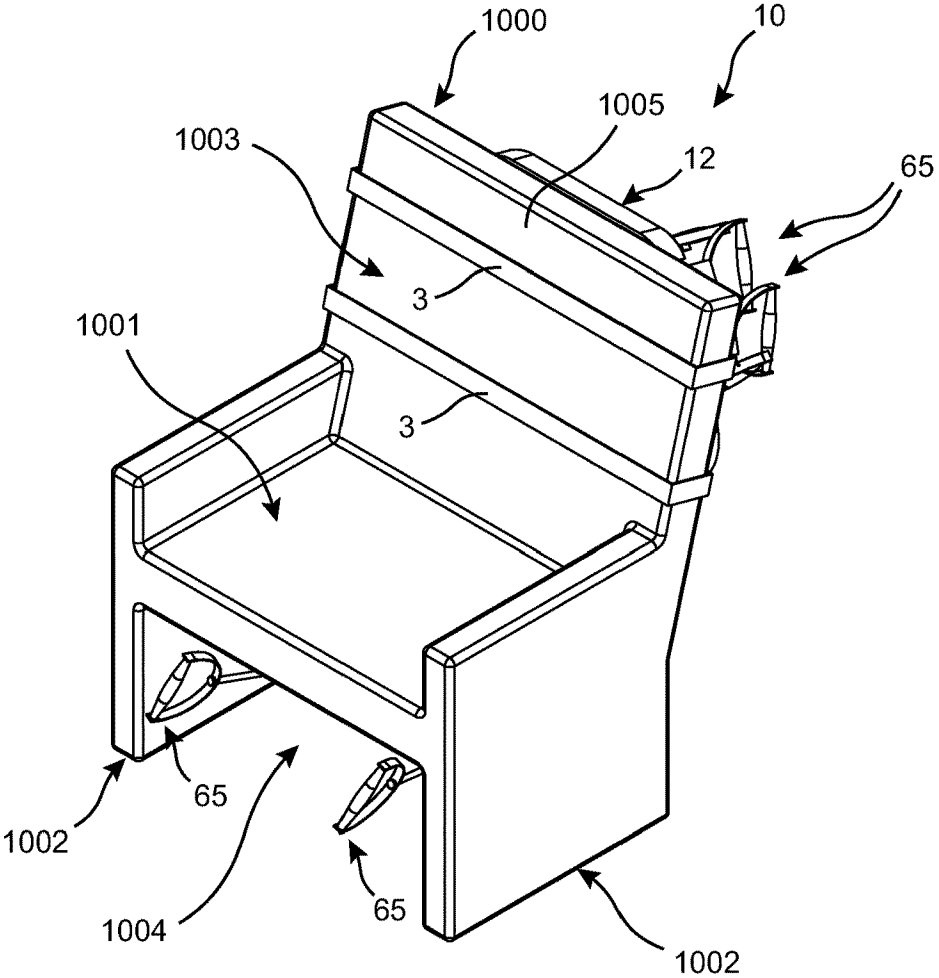
FIG. 7 is a front perspective view of the exercise device when coupled to a mounting structure (chair) with the exercise device in the retracted configuration.
Figure 10:
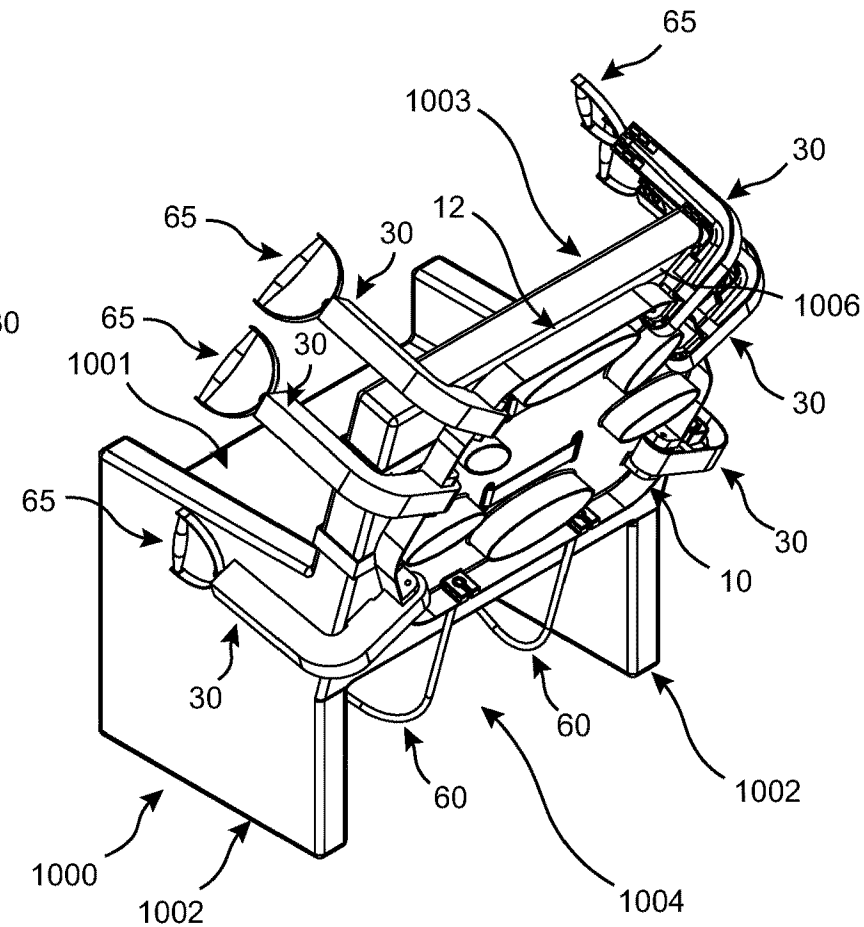
FIG. 10 is a rear perspective view of the exercise device when coupled to the mounting structure with the exercise device in the operational configuration.
Figure 9:
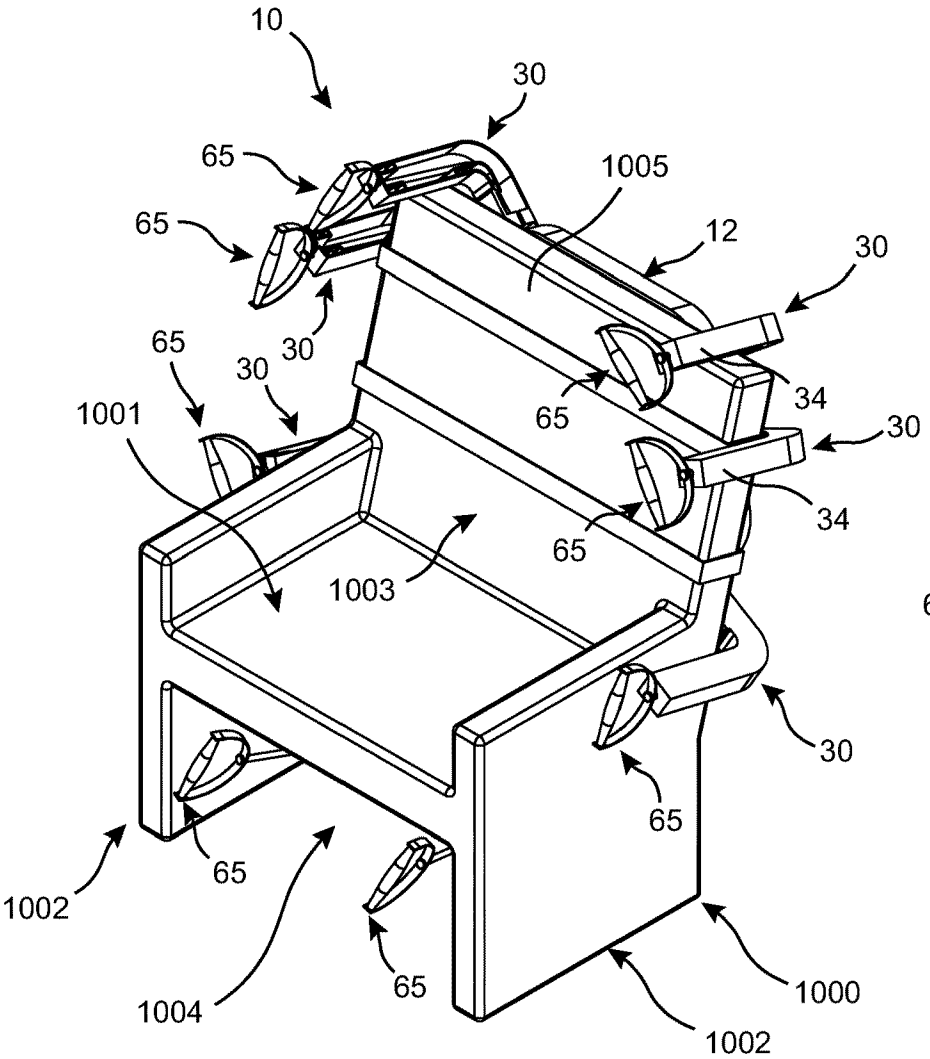
FIG. 9 is a front perspective view of the exercise device when coupled to the mounting structure with the exercise device in the operational configuration.

As best shown in FIGS. 3 and 5, each of the arms 30 includes an open side surface for providing lateral access into a hollow interior 36 thereof. The openness of the lateral side surface results in each of the arms 30 having a shell-like or tray-like configuration with a rim or peripheral wall extending around a periphery of the hollow interior 36. The hollow interior 36 of each of the arms 30 is configured to receive at least a portion of a corresponding one of the resistance members 60 therein. Each of the arms 30 includes an anchoring structure 38 formed within the hollow interior 36 to which the first end of a corresponding one of the flexible bodies 62 may be coupled. In the illustrated embodiment, the anchoring structure 38 is formed within the first leg 33 of each of the arms 30, but the anchoring structure 38 may alternatively be formed within the second leg 34 of each of the arms 30 without necessarily departing from the scope of the present invention. The anchoring structure 38 may have similar structure to the anchoring structure 22 of the base member 22, such as being formed as a key-hole shaped opening allowing for lateral entry of the corresponding cylindrical flexible body into the hollow interior 36 in a single lateral direction. The key-hole shaped opening may form a narrow passageway through the hollow interior 36 having a smaller diameter or width dimension than an adjacent portion of the hollow interior 36 as well as an enlarged portion of the corresponding flexible body 62 formed at the first end thereof. Such a coupling configuration is explained in greater detail with reference to the discussion of FIGS. 11-13 included hereinafter. However, the anchoring structure 38 and the first end of each of the flexible bodies 62 may include any complimentary coupling structures, such as any of those mentioned previously, while remaining within the scope of the present invention.

At least a first portion of a length of the corresponding flexible body 62 is routed through the hollow interior 36 from the anchoring structure 38 towards the distal end 32 of the corresponding arm 30. The distal end 32 of each of the arms 30 may include a slot or opening extending into the rim or peripheral wall of each of the arms 30 in a direction from the open side to a closed side of each of the arms 30. The slot or opening may once again be provided as a key-hole shaped opening allowing for the lateral entry of the corresponding flexible body 62 therein while having a diameter preventing axial passage of an enlarged portion of the flexible body 62 or the substantially larger control member 65 thereby. As such, when the resistance member 60 is not in use, the control member 65 may retract to a position adjacent the distal end 32 of the corresponding arm 30.

Each of the flexible bodies 62 is configured to slide through the opening formed at the second end 32 of the corresponding arm 30 during extension of the corresponding flexible body 62 while the first end of the corresponding flexible body 62 remains fixed at the corresponding anchoring structure 38. Additionally, each of the flexible bodies 62 may bend at or otherwise pivot at an edge formed by the opening at the distal end 32 of the corresponding arm 30 if the associated control member 65 is moved to a position out of axial alignment with the second leg 34 of the corresponding arm 30, wherein the edge of the opening forms an engaging surface for engaging a portion of the corresponding flexible body 62 when slide and/or pivoted relative to the distal end 32. The exercises performed via extension of one of the control members 65 may include the corresponding flexible body 62 bearing against one or more of the corresponding anchoring structure 38, a corresponding bend formed in the arm 30 at the junction of the legs 33, 34 thereof, and at the edge defining the opening at the corresponding distal end 32 of the arm 30.

The arms 30 as shown as being provided in an array with adjacent ones of the arms 30 spaced from each other about a perimeter of the base member 12 as defined by the rim 16. The arms 30 are arranged to include axes of rotation facilitating the arms 30 extending around the mounting structure at any number of different orientations, such as extending over the mounting structure, around a side surface of the mounting structure, or below the mounting structure. The arms 30 may be provided in paired sets with each of the paired sets including the corresponding pair of the arms 30 symmetrically arranged relative to a central axis of the base member 12. The symmetrical arrangement of each pair of the arms 30 allows for exercises to be performed similarly with respect to the left-hand and right-hand sides of the user, or to utilize a control member 65 associated with each of the symmetrically arranged arms 30.

Figure 11:
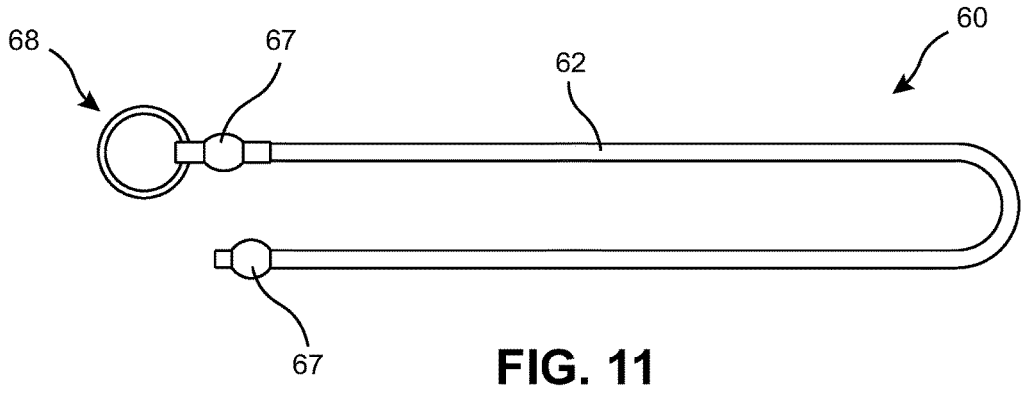
FIG. 11 is a side elevational view of a resistance member configured for use with the exercise device of FIGS. 1-10 according to an embodiment of the present invention.
Figure 12:
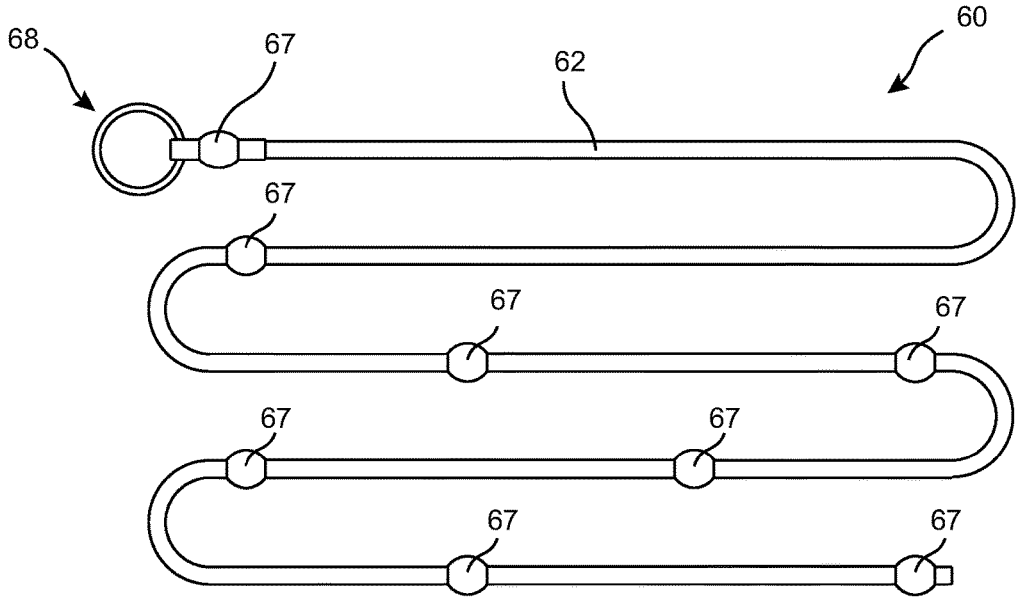
FIG. 12 is a side elevational view of a resistance member configured for use with the exercise device of FIGS. 1-10 according to another embodiment of the present invention.

FIGS. 11 and 12 illustrate exemplary resistance members 60 suitable use with the base member 12 and/or the arms 30 as disclosed throughout FIGS. 1-10. FIG. 11 illustrates the resistance member 60 as including a longitudinally extending flexible body 62 having an enlarged portion 67 disposed at each of the first end and the opposing second end of the flexible body 62. Each of the enlarged portions 67 has an outer diameter greater than an outer diameter of a portion of the flexible body 62 not forming one of the enlarged portions 67. As explained hereinabove, each of the enlarged portions 67 may provide a stopping surface for preventing axial motion of the corresponding enlarged portion 67 beyond one of the anchoring structures 22, 38 or beyond the distal end 32 of one of the arms 30 due to each of the enlarged portions 67 having too great of a diameter to pass axially through the corresponding opening or slot. The second end of the resistance member 60 further includes a coupling feature 68 configured for removably coupling any of a variety of different control members 65 to the resistance member 60. In the illustrated example, the coupling feature 68 is a ring to which a corresponding structure of the control member 65 may be clipped, hooked, or otherwise mechanically joined for removably coupling the control member 65 to the second end of the flexible body 62.

The resistance member 60 illustrated in FIG. 12 is substantially identical to the resistance member 60 illustrated in FIG. 11 except for the inclusion of additional enlarged portions 67 intermediate the first and second ends of the flexible body 62. The additional enlarged portions 67 allow for the resistance member 60 to be coupled to a corresponding one of the anchoring structures 22, 38 at a variety of different locations relative to the longitudinal direction of the flexible body 62. By altering the point at which the flexible body 62 is axially restrained relative to the base member 12 or one of the arms 30, the range of motion of the flexible body 62 as well as the resulting resistive forces generated by the flexible body 62 when the flexible body 62 is extended may be altered in accordance with the needs of the user, the configuration of the mounting structure, or the specific exercise being performed. For example, a longer length of the flexible body 62 may be required where a greater extension of an arm or a leg of the user is necessary or when the mounting structure is relatively large and in need of a greater distance of routing of the flexible body 62 to reach the user. A different length, and hence a different resistive force, may also be necessary based on the abilities of the user.

Figure 13:
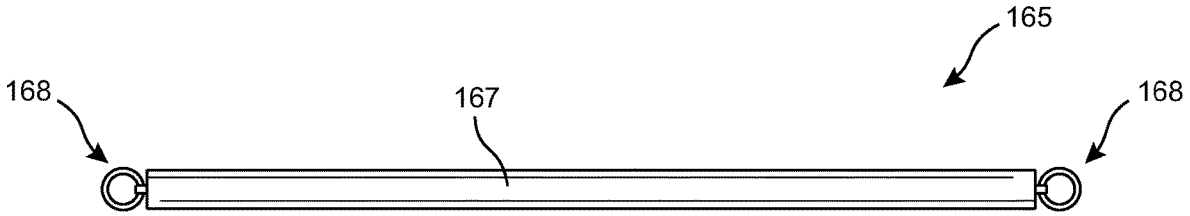
FIG. 13 is a side elevational view of an exercise bar configured for use with the exercise device of FIGS. 1-10 according to an embodiment of the present invention.

FIG. 13 illustrates a control member 165 that is configured for coupling to the second end of each of two different resistance members 60. The control member 165 forms a longitudinally extending bar or pole 167 having one of the coupling features 68 disposed at each end thereof, wherein each of the coupling features 68 is configured to removable coupling to a corresponding second end of one of the flexible bodies 62. The control member 165 accordingly forms a bar similar to that used in a bench press or similar exercise wherein both of the arms (or legs) of the user are used in conjunction to perform the associated exercise. One skilled in the art should appreciate that other control members suitable for use with at least two of the flexible bodies 62 may also be utilized while remaining within the scope of the present invention.

In use, a user of the exercise device 10 positions the base member 12 adjacent a rear surface of the corresponding mounting structure. The user then utilizes the coupling system 2 to securely couple the base member 12 to the mounting structure in a manner wherein the base member 12 remains substantially stationary during use thereof. The mounting of the base member 12 to the mounting structure may include extending the straps 3 around corresponding portions of the mounting structure, as is applicable.

Once coupled to the mounting structure, the user is positioned wherein a surface of the user is facing towards and/or engaging the first (front) surface of the mounting structure. The surface of the user may be a rearward facing surface of the user such as the back or buttocks of the user, but other surfaces of the user may face towards the first surface of the mounting structure. The user may then choose which of the arms 30 to adjust from the retracted positions thereof to the operational positions thereof for the given exercise. The user may then grasp or otherwise engage one or more of the control members 65 disposed external to the base member 12 with a hand or a foot of the user. The base member 12 is configured to remain substantially stationary relative to the mounting structure during use of the exercise device 10, hence the movement of each of the control members 65 by the user causes each of the corresponding flexible bodies 62 to expand, retract, or pivot relative to the base member 12 or one of the arms 30, as the case may be.

The movement of each of the control members 65 relative to the base member 12 or one of the arms 30 accordingly allows for the user to execute various different exercises and physical training motions. The exercises may include the user moving one of the control members 65 relative to a corresponding pivot point formed by the base member 12 or one of the arms 30, such as one of the anchoring structures 22 or an edge of the opening formed at the distal end 32 of one of the arms 30. At least some of the exercises capable of being performed during use of the exercise device 10 may include one of the resistance members 60 directly coupled to one of the anchoring structures 22 of the base member 12 being extended under the corresponding mounting structure, such as through the opening 1004 present beneath the seat 1001 of the exemplary chair 1000. At least some of the exercises capable of being performed during use of the exercise device 10 may also include one of the resistance members 60 coupled to one of the arms 30 being extended around a periphery of the mounting structure where the first surface thereof transitions to the second surface thereof, such as around an upper surface of either of the side surfaces of the backrest 1003 of the exemplary chair 1000. The exercises and physical training motions that can be executed during use of the exercise device 10 include a chess press, an alternating chest press, a shoulder press, an alternating shoulder press, a front shoulder raise, a side shoulder raise, a combined front and side raise, a chest fly, a tricep extension, a straight arm front pull down, a straight arm side pull down, an abdominal crunch, a chop, a waist rotation, a single arm sweep, a bicep curl, a leg extension, a knee raise, a straight leg raise, a straight leg side kick, a row, a shrug, a leg curl, a straight leg pull down, a leg press, a leg adduction, and a back extension, as non-limiting examples.

The exercise device 10 may be adapted to include various beneficial features. The exercise device 10 may be configured to continuously monitor a heart rate, a blood pressure, a strength, a range of motion, and a flexibility of the user. The resistance members 60 of the exercise device 10 may be configured to increase in resistance as the user progresses in ability level. The exercise device 10 may include a Bluetooth® or Wi-Fi capability for communicating information regarding the exercise device 10 or the user to an exterior computer system that may be accessed by the user, a medical professional, or an insurance agent, as non-limiting examples. The exercise device 10 may include an auditory system configured to provide verbal feedback or instructions to the user regarding the user's progress or methods for properly utilizing the exercise device 10. The exercise device 10 may be further adapted to allow for new programs to be downloaded to a computer system associated with operation of the exercise device 10. The exercise device 10 may also include a flash drive port for communicating with a flash drive including any programs or data associated with use of the exercise device 10. The exercise device 10 may include an alarm system for communicating to the user when a workout or training session is to begin. The exercise device 10 may be configured to synchronize with a smart device and to communicate data to and from the smart device. The resistance members 60 of the exercise device 10 may be configured to retract into the interior chamber 13 of the base member 12 when the exercise device 10 is not in use. The resistance members 60 may include smart technology wherein the resistance of the resistance members 60 is varied according to the ability of the instantaneous user of the exercise device 10. The exercise device 10 may be waterproof to allow for the exercise device 10 to be used for under water therapy in a setting such as a swimming pool, wherein the base member 12 may be coupled to a structure or surface associated with the swimming pool. The resistance members 60 may be removable and replaceable for when an elasticity of the resistance members 60 is decreased during use of the resistance members 60. The exercise device 10 may include an accompanying pulley system configured to engage a portion of one of the flexible bodies 62 of the resistance members 60 to adapt the exercise device 10 for additional exercises or motions. The exercise device 10 may include interchangeable and removable control members 65 for varying the manner in which the user manipulates each of the control members 65.

The exercise device 10 advantageously allows for the user to secure the exercise device 10 to any mounting structure having a rearward facing surface for engaging the base member 12 and a front facing surface for engaging a surface of the user. This allows for the exercise device 10 to be adapted to various different configurations and structures. Additionally, the inclusion of multiple resistance members 60 capable of extending from the base member 12 in various different directions allows the exercise device 10 to be adapted for various different exercise and training configurations, such as those listed hereinabove. The exercise device 10 also advantageously allows for the user to engage the front surface of the mounting structure instead of a front surface of the exercise device 10. This allows for the user to avoid having to apply a force to the body of the user when the user manipulates one of the control members 65. For example, an exercise device requiring the user to sit directly on the exercise device and having extendable resistance members will apply a resulting force to a buttocks of the user when the user extends the resistance members away from the portion of the exercise device engaging the user. In contrast, the mounting of the base member 12 to the corresponding mounting structure allows for the extension of one or more of the control members 65 away from the base member 12 without the resistive forces provided by the resistance members 60 being indirectly transferred and applied to a surface of the user.

The portability and removable nature of the exercise device 10 also aids in preventing undesired contact with any sweat, microbes, or other substances or materials originating from another user of the exercise device 10. This can be accomplished by switching a mounting of the exercise device 10 from one mounting structure to another mounting structure following extended use of the exercise device 10. A fresh mounting structure can replace the soiled mounting structure that was previously used to allow for cleaning of the original mounting structure.

Figure 14:
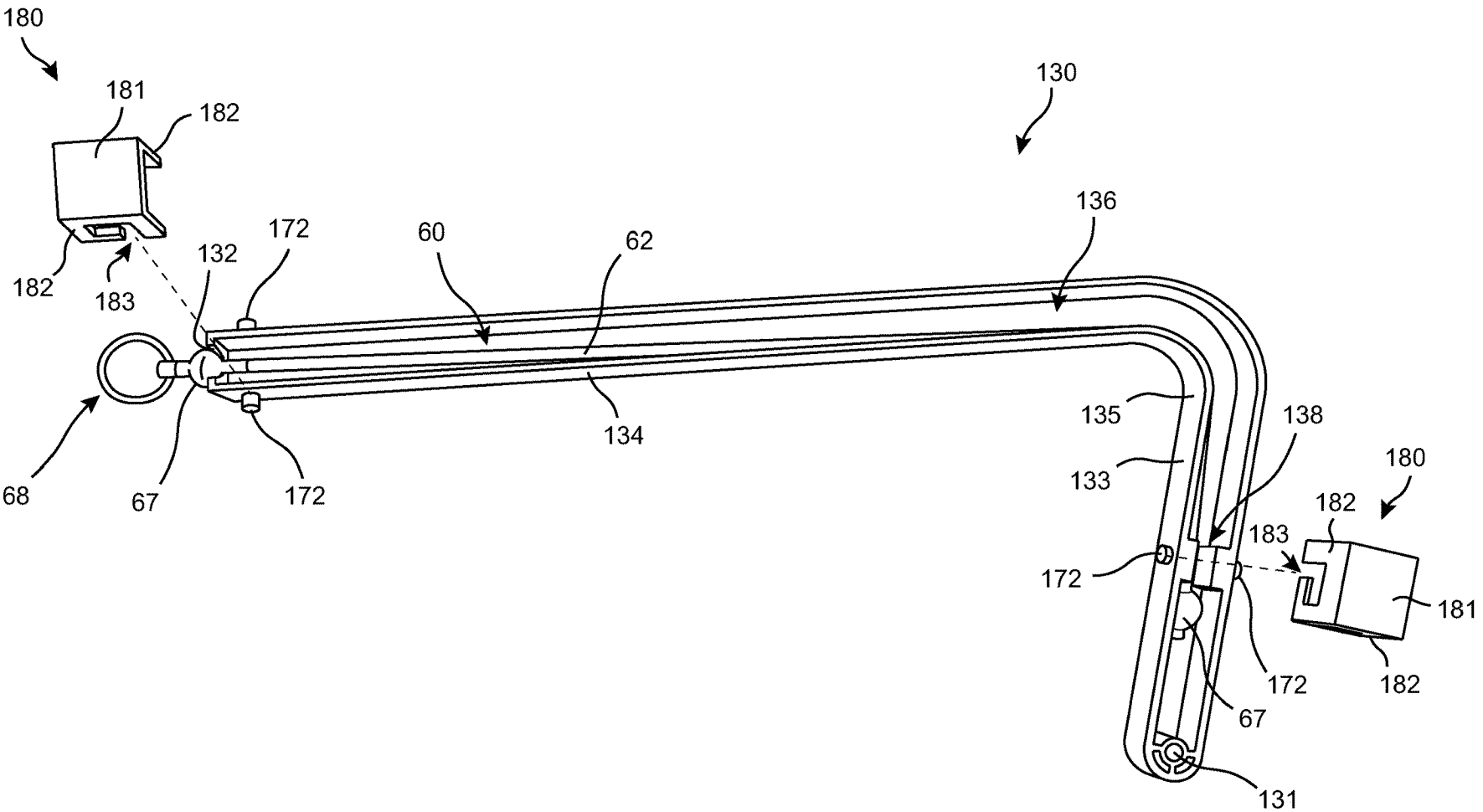
FIG. 14 is a partially exploded top perspective view of a pivoting arm configured for use with the exercise device of FIGS. 1-10.

FIG. 14 illustrates an arm 130 for use with the exercise device 10 according to another embodiment of the present invention. The arm 130 is substantially similar to each of the arms 30 illustrated in FIGS. 1-10 and may accordingly be substituted for any of the arms 30 while remaining within the scope of the present invention.

The arm 130 includes a first end 131 defining an axis of rotation thereof, a freely disposed second (distal) end 132 formed opposite the first end 131, a first leg 133 including the first end 131, and a second leg 134 including the second end 132. An angle present between the legs 133, 134 is slightly smaller than that present between the legs 33, 34 of each of the arms 30, and may be about 75-80 degrees.

The arm 130 also includes an open-sided configuration wherein a peripheral wall 135 extends around a hollow interior 136 of the arm 130. The peripheral wall 135 is rim-like in configuration and defines a passageway through which one of the flexible bodies 62 may be routed. The arm 130 includes an anchoring structure 138 similar to the anchoring structure 38 for axially restraining the first end of the corresponding flexible body 62 due to the presence of the larger diameter enlarged portion 67 of the flexible body 62. The arm 130 also includes the distal end 132 having a slot or opening penetrating the peripheral wall 135 with the slot or opening configured to allow for lateral passage of the flexible body 62 therein while again preventing axial passage of one of the enlarged portions 67 therethrough.

The arm 130 is distinguished from the arm 30 by the inclusion of a pair of retaining elements 180. Each of the retaining elements 180 is configured to cooperate with the surfaces of the arm 130 defining the hollow interior 136 thereof to fully surround a portion of the flexible body 62 routed through the hollow interior 136 in order to prevent an undesired lateral removal of the flexible body 62 from the arm 130. Each of the retaining elements 180 is configured to engage the arm 130 at one of the positions wherein the enlarged portions 67 of the flexible body 62 cannot freely pass axially due to a decreased dimension in the hollow interior 136 of the arm 130, such as is the case at the anchoring structure 138 and the distal end 132 of the arm 130.

Each of the retaining elements 180 includes a U-shaped configuration with a pair of side walls 182 depending from a central wall 181. Each of the side walls 182 includes an L-shaped slot 183 at an edge thereof opposite the central wall 181. Each of the L-shaped slots 183 is configured to receive a corresponding projection 172 extending laterally outwardly from the peripheral wall 135 of the arm 130. The projections 172 may be provided in paired sets at or adjacent each of the anchoring structure 138 and the second end 132, wherein each paired set of the projections 172 is arranged on portions of the peripheral wall 135 disposed to opposite sides of the hollow interior 136.

In use, each of the retaining elements 180 is moved relative to the arm 130 to cause the paired set of the projections 172 to be received in the corresponding L-shaped slots 183 until each of the projections 172 reaches a distal end of each of the L-shaped slots 183. This includes motion of each of the retaining elements 180 in two perpendicular directions to traverse the L-shape of each of the slots 183. Once fully received, the side walls 182 straddle the opposing portions of the peripheral wall 135 adjacent the corresponding paired set of the projections 172 while the central wall 181 closes off the otherwise open side of the arm 130 providing the access to the hollow interior 136. Each of the retaining elements 180 accordingly surrounds a corresponding portion of the flexible body 62 adjacent one of the enlarged portions 67 to prevent both axial removal and lateral removal of the surrounded portion of the flexible body 62 from the hollow interior 136. It should be apparent that other coupling methods, such as the use of a snap-fit connection, a locking mechanism such as a pin, or the like may alternatively be used to fix the position of each of the retaining elements 180 relative to the arm 130 while remaining within the scope of the present invention.

From the foregoing description, one ordinarily skilled in the art can easily ascertain the essential characteristics of this invention and, without departing from the spirit and scope thereof, can make various changes and modifications to the invention to adapt the invention to various usages and conditions.

What is claimed is:

1. An exercise device comprising:

a base member configured for engaging a mounting structure, wherein the mounting structure includes a first surface and an oppositely arranged second surface, the first surface facing towards a user and the second surface configured to engage the base member;

a coupling system for coupling the base member to the mounting structure;

a plurality of resistance members coupled to the base member, each of the plurality of the resistance members including a control member configured to be manipulated by a portion of the user; and a plurality of arms pivotally coupled to the base member with the plurality of the arms spaced apart from each other about a perimeter of the base member, wherein the plurality of the arms are provided in symmetrically arranged pairs with respect to a central axis of the base member, wherein each of the plurality of the arms has at least one of the plurality of the resistance members directly coupled thereto.

2. The exercise device of claim 1, wherein the first surface of the mounting structure is configured to engage a rearward facing surface of the user.

3. The exercise device of claim 2, wherein the first surface of the mounting structure is configured to engage one of the back of the user or the buttocks of the user.

4. The exercise device of claim 1, wherein an extension of the control member of one of the plurality of the resistance members away from the base member results in a force being applied to the second surface of the mounting structure.

5. The exercise device of claim 1, wherein at least a portion of the coupling system extends around the mounting structure and engages the first surface of the mounting structure.

6. The exercise device of claim 1, wherein one of the plurality of the arms is configured to pivot between a retracted position and an operational position.

7. The exercise device of claim 6, wherein the retracted position includes an entirety of the one of the plurality of the arms disposed rearwardly of the second surface of the mounting structure and the operational position includes at least a portion of the one of the plurality of the arms extending forwardly beyond the second surface of the mounting structure.

8. The exercise device of claim 6, wherein a portion of the one of the plurality of the arms extends over an upper surface of the mounting structure connecting the first surface of the mounting structure to the second surface of the mounting structure when the one of the plurality of the arms is in the operational position thereof.

9. The exercise device of claim 6, wherein a portion of the one of the plurality of the arms extends adjacent a side surface of the mounting structure connecting the first surface of the mounting structure to the second surface of the mounting structure when the one of the plurality of the arms is in the operational position thereof.

10. The exercise device of claim 6, wherein an axis of rotation of the one of the plurality of the arms is spaced inwardly from the perimeter of the base member.

11. The exercise device of claim 10, wherein a surface of the base member facing away from the mounting structure forms a stop for limiting a range of the pivoting of the one of the plurality of the arms when adjusted between the retracted and operational positions thereof.

12. The exercise device of claim 1, wherein one of the plurality of the arms includes a first leg and a second leg arranged at an angle relative to the second leg.

13. The exercise device of claim 12, wherein the angle present between the first leg and the second leg is greater than 0 degrees and less than or equal to 90 degrees.

14. The exercise device of claim 1, wherein a distal end of one of the plurality of the arms forms an engagement surface about which one of the plurality of the resistance members pivots and/or slides during motion of the corresponding control member.

15. The exercise device of claim 1, wherein one of the plurality of the resistance members extends under a portion of the mounting structure connecting the first surface to the second surface thereof during a manipulating of the corresponding control member by the portion of the user.

16. The exercise device of claim 1, wherein the mounting structure is one of a chair or a bed.

* * * * *